US005564666A

United States Patent [19]

Pfeil

[11] Patent Number: 5,564,666

[45] Date of Patent: Oct. 15, 1996

[54] MOUNTING BRACKET FOR CURTAIN RODS

[75] Inventor: Walter W. Pfeil, North Kingstown, R.I.

[73] Assignee: Kenney Manufacturing Company, Warwick, R.I.

[21] Appl. No.: 267,046

[22] Filed: Jun. 28, 1994

[51] Int. Cl.[6] ..... A47H 1/10

[52] U.S. Cl. ..... 248/263; 248/264

[58] Field of Search ..... 248/220, 254, 248/255, 253, 261, 263, 265; 211/105.2

[56] References Cited

U.S. PATENT DOCUMENTS

| | | | |
|---|---|---|---|
| 799,092 | 9/1905 | Rosenfeld . | |
| 887,272 | 5/1908 | Robinson . | |
| 1,593,114 | 7/1926 | Wyatt | 248/255 |
| 1,658,815 | 2/1928 | Oskamp . | |
| 1,790,389 | 1/1931 | Rasp | 248/255 |
| 1,923,024 | 8/1933 | Kenney et al. . | |
| 1,956,501 | 4/1934 | Frame . | |
| 2,099,770 | 11/1937 | Plaunt . | |
| 2,374,165 | 4/1945 | Barbee | 248/254 |
| 2,451,034 | 10/1948 | Lanphere . | |
| 2,480,027 | 8/1949 | Jeffreys | 248/255 |
| 3,218,017 | 11/1965 | Butler . | |
| 4,226,395 | 10/1980 | Bellinger | 248/263 |
| 4,283,034 | 8/1981 | Sheeman | 248/263 |
| 4,352,433 | 10/1982 | Ford | 211/105.1 |
| 4,399,917 | 8/1983 | Ohman | 211/87 |
| 4,607,818 | 8/1986 | Georgopoulos | 248/544 |
| 4,889,305 | 12/1989 | Mahan | 248/265 |
| 4,961,296 | 10/1990 | Morehouse | 52/37 |
| 5,082,226 | 1/1992 | Mahan | 248/265 |

*Primary Examiner*—Ramon O. Ramirez
*Assistant Examiner*—Gwendolyn A. Wrenn
*Attorney, Agent, or Firm*—Fish & Neave; Richard A. Inz; Garry J. Tuma

[57] ABSTRACT

This invention relates to a mounting bracket for use in mounting multiple curtain rods of varying sizes at various heights. The mounting bracket is composed of a plurality of bracket segments, with each bracket segment including a number of rod support flanges. Each rod support flange has hook means for engaging slots in curtain rods. The bracket segments are removably attached to one another.

8 Claims, 5 Drawing Sheets

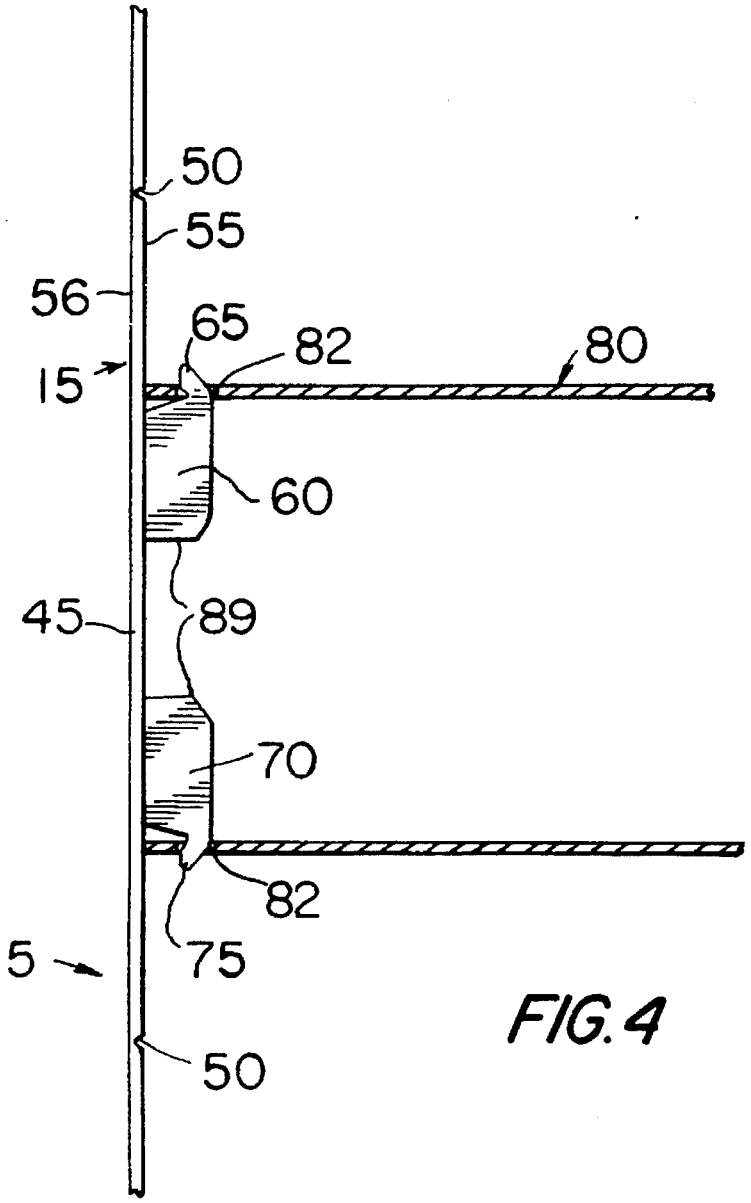
FIG. 4
FIG. 3
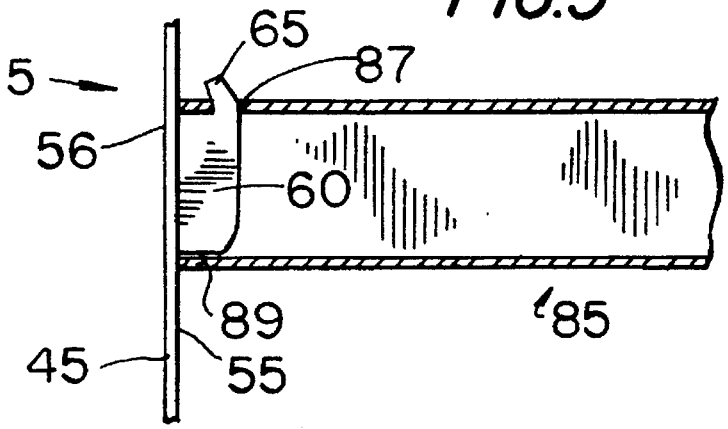

MOUNTING BRACKET FOR CURTAIN RODS

BACKGROUND OF THE INVENTION

Present curtain rod mounting brackets generally allow the mounting of one or two curtain rods at the same height. Most present curtain rod mounting brackets do not, however, allow for the simultaneous mounting of curtain rods at different heights. This drawback limits the variety of window treatments available with such curtain rod mounting brackets.

With present curtain rod mounting brackets, the mounting of more than two curtain rods at different heights generally requires the installation of additional brackets. The use of additional brackets increases the complexity of installation and the cost of mounting the curtain rods; the consumer must purchase and install additional brackets and the manufacturer and seller must maintain an inventory of the additional brackets.

Some curtain rod mounting devices require different left and right brackets. In this case, costs and complexity are again increased, as the consumer must buy both types of brackets, the manufacturer must produce an additional type of bracket, and the manufacturer and seller must maintain an inventory of the additional brackets.

Further, some brackets are quite complicated, increasing manufacturing costs and difficulties in installation.

Other brackets require specific types of window frames and thus lack the versatility necessary for use with a wide variety of window frame and wall types.

Many brackets only accommodate a single size of curtain rod.

U.S. Pat. Nos. 2,099,770 and 4,399,917 overcome some of the drawbacks associated with standard curtain rod mounting brackets by allowing the mounting of multiple curtain rods at different heights.

U.S. Pat. No. 2,099,770 is a curtain fixture that can be attached to a window frame without the use of screws or nails. The fixture is held in place by the force of springs that urge hinged arms together, clamping the window frame between the arms. Brackets for holding curtain rods can be positioned at various heights by engaging two of a number of vertically aligned hooks positioned at various heights on one of the bracket's arms. This curtain fixture requires different left and right brackets.

U.S. Pat. No. 4,399,917 is a dual curtain rod assembly and includes two curtain rods as well as mounting brackets and spacer bars that hold the two rods a fixed distance apart, one directly above the other, forming a rigid structure for mounting on a wall.

Though U.S. Pat. No. 2,099,770 offers the advantage of mounting multiple curtain rods at a variety of heights, its springs and hinged arms increase manufacturing costs and the difficulty of installation. Further, as this device uses spring tension for attachment onto window frames, it may not be able to support heavy curtains and curtain rods. Also, this device can only be mounted on certain types and sizes of window frames. In this fixture, the left and right brackets are different, increasing manufacturing and inventory costs and increasing installation complexity.

U.S. Pat. No. 4,399,917 allows the mounting of only two rods, limiting the range of window treatments the device can provide. This device requires the user to assemble the structure, as well as position it on a wall or window frame.

As the dual curtain rod assembly can be quite large and cumbersome, installing the assembled structure may be difficult.

Moreover, in the devices described in either patent, variation in vertical positions of the curtain rods is limited. In U.S. Pat. No. 2,099,770, the maximum separation between curtain rods is the width of a window frame member. In U.S. Pat. No. 4,399,917, the distance between the curtain rods is fixed by the length of the brackets and spacer bars. Neither device allows the user to stagger the curtain rods, mounting the rods alternately closer to or further from the window frame, depending on the height at which the rod is mounted. Such a feature would greatly increase the variety of available window treatments.

It would therefore be desireable to provide a mounting bracket that will allow the mounting of a plurality of curtain rods at various heights and alternately closer to and further from the window frame.

It would also be desireable to provide a mounting bracket that can accommodate more than one size of curtain rod.

It would be still further desireable to provide a mounting bracket that is inexpensive to manufacture, simple to install and is easily customizable.

It would be still further desireable to provide a mounting bracket that can be used on a large variety of wall and window frame types.

SUMMARY OF THE INVENTION

It is therefore an object of this invention to provide a mounting bracket that will allow the mounting of a plurality of curtain rods at various heights and alternately closer to and further from the window frame.

It is another object of this invention to provide a mounting bracket that can accommodate more than one size of curtain rod.

It is still another object of this invention to provide a mounting bracket that is inexpensive to manufacture, simple to install and is easily customizable.

It is still another object of the invention to provide a mounting bracket that can be used on a large variety of wall and window frame types.

These and other objects of the invention are accomplished in accordance with the principles of the invention by providing a mounting bracket for use in mounting multiple curtain rods of varying sizes at various heights. The mounting bracket is composed of a plurality of bracket segments with each bracket segment including a number of rod support flanges. Each of the rod support flanges has hook means for engaging slots in curtain rods. The bracket segments are removably attached to one another.

BRIEF DESCRIPTION OF THE DRAWINGS

The above and other objects and advantages of this invention will be apparent upon consideration of the following detailed description, taken in conjunction with the accompanying drawings, in which like reference numbers refer to like parts throughout and in which:

FIG. 3 is a side elevation and section of a portion of the mounting bracket shown in FIG. 2 with a curtain rod mounted on one rod support flange;

FIG. 4 is a side elevation and section of a portion of the mounting bracket shown in FIG. 2 with a curtain rod mounted on two rod support flanges;

DESCRIPTION OF THE PREFERRED EMBODIMENTS

Figure 1:
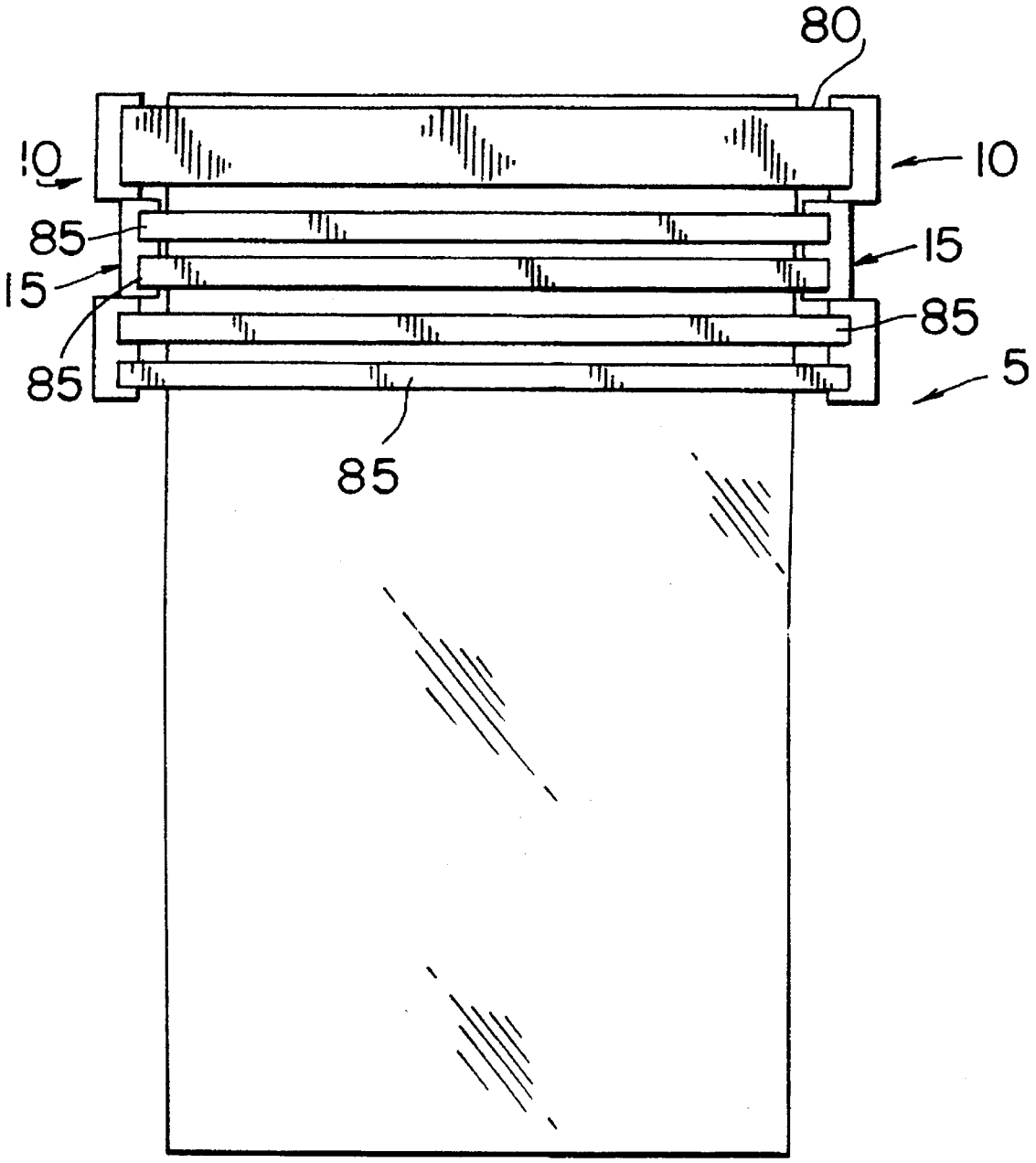
FIG. 1 is a front elevation view of the mounting bracket fixed to a window frame and supporting curtain rods at various heights.
Figure 2:
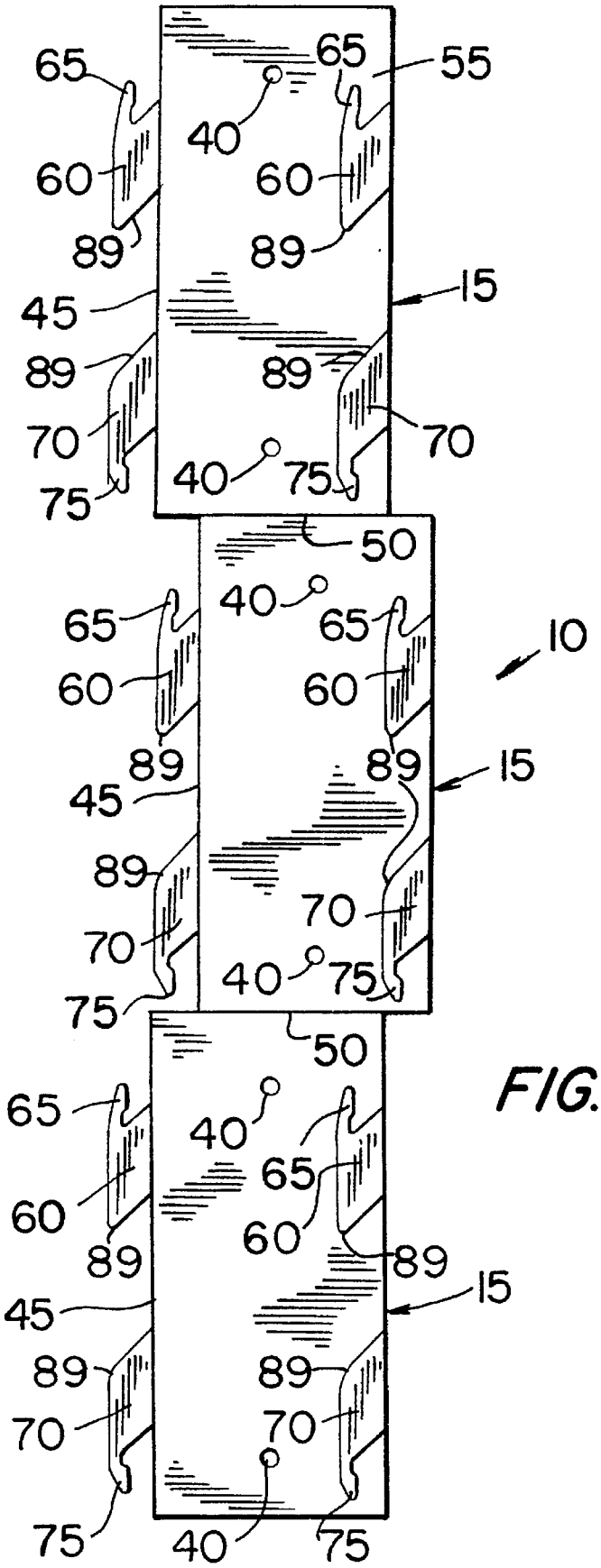
FIG. 2 is a perspective view of the mounting bracket.
Figure 5:
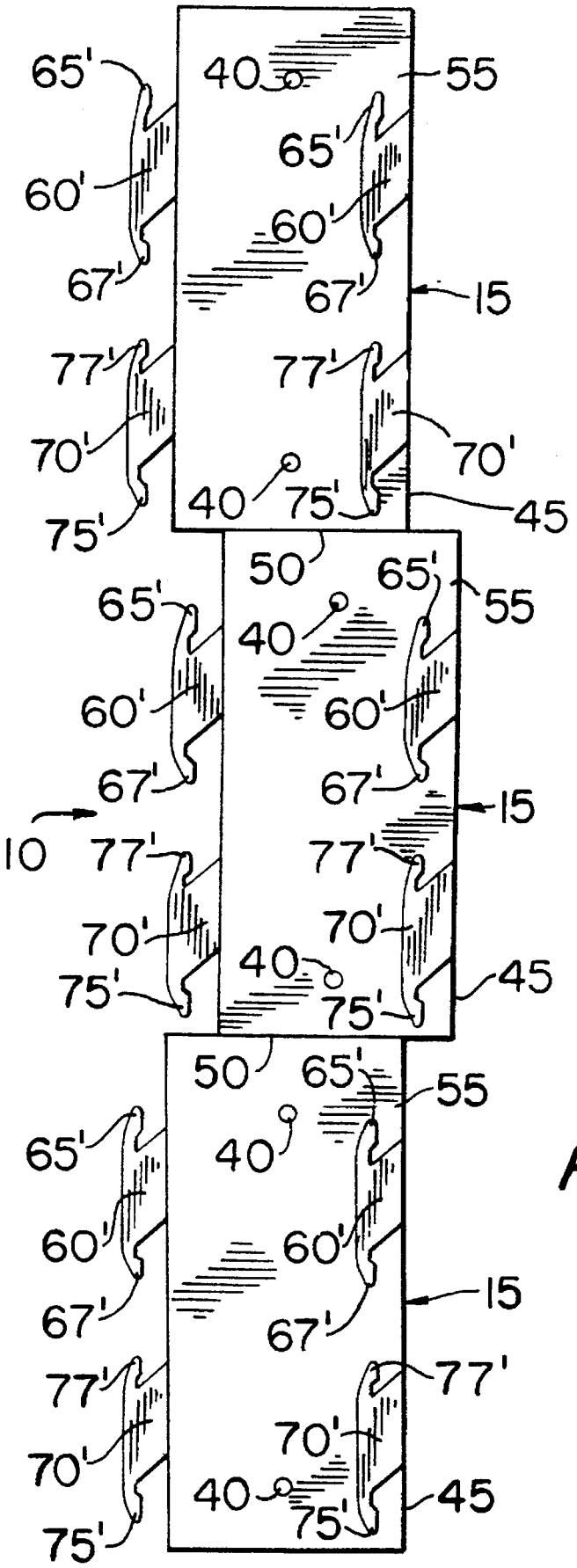
FIG. 5 is a perspective view of an alternative embodiment of the mounting bracket.

Mounting bracket 10 is composed of a number of bracket segments 15 joined together at joints 50 that are scored or otherwise weakened to allow for easy removal of individual bracket segments 15 (see FIG. 2). Bracket segments 15 are arranged in a staggered pattern, having longitudinal axes that are coincident with two parallel and offset axes. Mounting bracket 10 may be composed of sheet metal or another suitable material such as ABS (acrylonite butadiene styrene).

Support plate 45 has front face 55 and rear face 56, which is mounted against wall 5 (see FIG. 3). Support plate 45 has holes 40, which allow bracket segment 15 to be secured to wall 5 by means of nails, screws or like fasteners. Adhesives or tape may also serve to secure support plate 45 against wall 5.

Rod support flanges 60 and 70 extend from the front face 55 of support plate 45, generally orthogonally to front face 55. Rod support flanges 60 and 70 are adapted to support two sizes of curtain rods: a larger curtain rod 80, and a smaller curtain rod 85. Rod support flanges 60 and 70 have hook means 65 and 75 to engage slots 82 and 87 in curtain rods 80 and 85.

In the case of the larger curtain rod 80, rod support flanges 60 and 70 are situated so that their respective hook means 65 and 75 can engage slots 82 at the top and bottom of each end of the larger curtain rod 80.

In the case of the smaller curtain rod 85, rod support flange 60 is of sufficient width so that hook means 65 can engage slot 87 in smaller curtain rod 85, while lower edge 89 is in contact with smaller curtain rod 85 so that smaller curtain rod 85 is secured to rod support flange 60.

When mounting bracket 10 is composed of an odd number of bracket segments 15, the brackets are interchangeable from one side of a window to the other, with the "right" bracket being the "left" bracket inverted, and vice versa. Further, given an odd starting number of bracket segments in a particular bracket, it is always possible to construct matching pairs of brackets of fewer numbers of bracket segments by breaking off appropriate bracket segments 15. This interchangeability reduces the costs associated with producing different left and right brackets and keeping an inventory of different brackets.

The various combinations and permutations of rod support flanges enable the installer to hang a variety of different types of window treatments from the same set of mounting brackets 10, and to change the window treatment from time to time without having to remove the mounting brackets and install new brackets each time a different window treatment is desired. Balloon valences, sheer curtains and cafe curtains, among other window treatments, and various combinations of these types of window treatments, are easily installed and changed.

Figure 6:
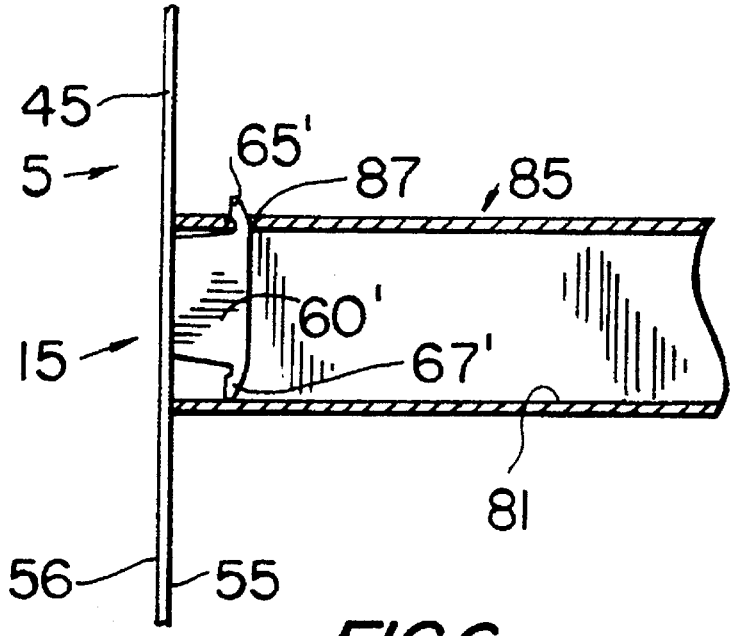
FIG. 6 is a side elevation and section of a portion of the mounting bracket shown in FIG. 5 with a curtain rod mounted on one rod support flange.
Figure 7:
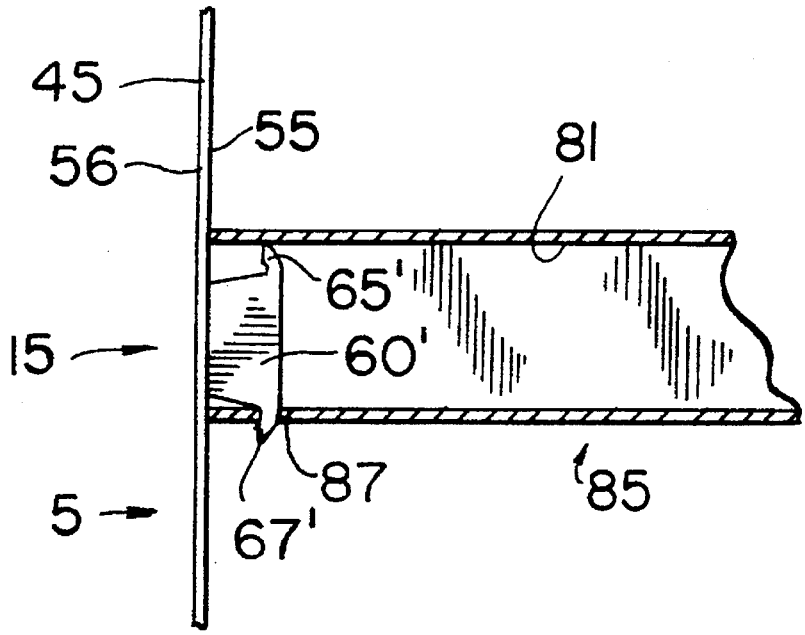
FIG. 7 is a side elevation and section of a portion of the mounting bracket shown in FIG. 5 with a curtain rod mounted on one rod support flange.

In an alternative embodiment of the mounting bracket, rod support flanges 60' and 70' include two hook means 65', 67' and 77', 75' respectively, with rod support flange 60' being of a width sufficient to cause hook means 67' to contact the wall 81 of curtain rod 85 when hook means 65' engages slot 87 of curtain rod 85, securing curtain rod 85 to rod support flange 60' (see FIG. 6). Likewise, when hook means 67' engages slot 87 of curtain rod 85, hook means 65' contacts wall 81 of curtain rod 85, securing curtain rod 85 to rod support flange 60' (see FIG. 7). This alternative embodiment allows the attachment of the smaller curtain rod 85 regardless of the orientation of mounting bracket 10.

Although not achieving all of the advantages of the previously described embodiments, a further embodiment that incorporates the invention has bracket segments 15 arranged in a staggered pattern having longitudinal axes that are coincident with three or more parallel and offset axes. Thus, in a mounting bracket having three or more bracket segments 15, the third bracket segment has its longitudinal axis parallel to but offset from the longitudinal axes of the first two bracket segments.

Thus it is seen that a mounting bracket for curtain rods is provided that combines all of the necessary properties of a multiplicity of mounting brackets, while being inexpensive to manufacture, simple to install and easily customizable. One skilled in the art will appreciate that the present invention can be practiced by other than the described embodiments, which are presented for purposes of illustration and not of limitation, and the present invention is limited only by the claims that follow.

I claim:

1. A mounting bracket for use in mounting on a surface, as part of a window treatment, a plurality of curtain rods of various lengths and widths at different heights comprising:

at least two bracket segments, each of the bracket segments having a longitudinal axis and being fixedly, removably attached to at least a portion of at least one of a first and a second edge of each bracket segment, wherein each bracket segment is formed from:

a support plate having front and rear faces, and a third and a fourth edge, the third and fourth edges being parallel to the longitudinal axis of the support plate, the first edge being parallel to the second edge and perpendicular to the longitudinal axis of the support plate; and at least two pairs of rod support flanges that are parallel to the longitudinal axis and project from the support plate away from the rear face, generally orthogonal to the support plate, wherein each pair comprises a first and a second rod support flange, the first and the second rod support flanges of each pair being collinear and parallel to the longitudinal axis of the support plate, the first rod support flange of each pair being adapted to receive one size of curtain rod, the second rod support flange of each pair being offset from the first rod support flange such that the first and the second rod support flanges together are adapted to receive another size of curtain rod.

2. The mounting bracket of claim 1, wherein the first and second rod support flanges are each adapted to receive and releasably hold in place the smaller size curtain rod.

3. The mounting bracket of claim 1, wherein the first and second pairs of rod support flanges include hook means for engaging slots in curtain rods.

4. The mounting bracket of claim 1, wherein the longitudinal axes of the bracket segments are coincident with a first and a second axis, the first and second axes being parallel to and offset from each other, with the longitudinal axes of adjacent bracket segments being alternately coincident with the first axis and the second axis.

5. The mounting bracket of claim 4, wherein the first and second rod support flanges are each adapted to receive and releasably hold in place the smaller size curtain rod.

6. The mounting bracket of claim 5, wherein the first and second rod support flanges include hook means for engaging slots in curtain rods.

7. The mounting bracket of claim 4 wherein each rod support flange has upper and lower hook means for engaging curtain rods.

8. The mounting bracket of claim 1 wherein each rod support flange has upper and lower hook means for engaging curtain rods.

* * * * *